United States Patent [19]

Pasternack

[11] 4,294,244

[45] Oct. 13, 1981

[54] RESPIRATOR WITH A COOLING DEVICE

[75] Inventor: Adalbert Pasternack, Bad Schwartau, Fed. Rep. of Germany

[73] Assignee: Drägerwerk Aktiengesellschaft, Fed. Rep. of Germany

[21] Appl. No.: 115,877

[22] Filed: Jan. 28, 1980

[30] Foreign Application Priority Data

Feb. 2, 1979 [DE] Fed. Rep. of Germany ..... 2903920

[51] Int. Cl.[3] ..... A62B 7/08

[52] U.S. Cl. ..... 128/202.26; 128/204.15; 128/402; 128/205.22

[58] Field of Search ..... 128/202.26, 204.15, 128/205.22, 402, 202.19, 201.25, 201.29

[56] References Cited

U.S. PATENT DOCUMENTS

| | | | |
|---|---|---|---|
| 3,491,752 | 1/1970 | Cowley | 128/205.22 X |
| 3,610,323 | 10/1971 | Troyer | 128/402 X |
| 3,869,871 | 3/1975 | Rybalko et al. | 128/201.25 X |
| 3,950,789 | 4/1976 | Konz et al. | 128/402 X |
| 4,188,947 | 2/1980 | Pasternack | 128/202.26 |

FOREIGN PATENT DOCUMENTS

| | | | |
|---|---|---|---|
| 1301725 | 8/1969 | Fed. Rep. of Germany | 128/204.15 |

*Primary Examiner*—Henry J. Recla
*Attorney, Agent, or Firm*—McGlew and Tuttle

[57] ABSTRACT

A respirator with a cooling device, includes a vest which is adapted to be used by a wearer of such a device and which has a coolant compartment associated therewith for containing a coolant. In addition, the vest provides means for mounting a respirator on the back of the wearer so that the respirator weight causes the vest to bear against the wearer's body and to cool it and, additionally, a coolant may be circulated through the respirator parts so as to cool them as well as to advantageously cool the respirating air. The coolant is advantageously carried in a structure which fits between the two walls of the vest and it is adapted to contain a coolant, such as, carbon dioxide. The gases formed by the melting of the carbon dioxide are directed over one or more elements of the respirator which advantageously includes an oxygen container, a breathing bag and a chemical cartridge, preferably for both generating oxygen and for retaining the carbon dioxide which is carried in the respiratory air. All of these respirator elements are arranged to either take air in from the outside and to circulate it through a breathing bag and enrich it with oxygen for continuously recirculating it in a closed cycle in which the air is both enriched with oxygen, and carbon dioxide is retained.

1 Claim, 3 Drawing Figures

RESPIRATOR WITH A COOLING DEVICE

FIELD AND BACKGROUND OF THE INVENTION

This invention relates to the construction of respirators in general and, in particular, to a new and useful respirator, particularly adaptable for use by persons working or moving in high temperature areas and areas which may contain contaminated breathing air.

The present invention is an improvement over German Pat. No. 2,700,492 (DE-AS No. 27 00 492), corresponding to U.S. Pat. No. 4,188,947, for "RESPIRATOR WITH A COOLING DEVICE". The invention is an improvement over the disclosure of the aforementioned patent dealing with a respirator having a chemical cartridge for the absorption of exhaled carbon dioxide and for the formation of oxygen which may be added to the respiratory air and which also includes a cooling device. In this patent, the coolant is contained in a coolant bag accommodated in the space between a contact wall of the breathing bag and the equipment wearer's back.

Except for the contact surface with the contact wall, the coolant bag may be enclosed in an insulating layer. The coolant bag has a filler nipple with a closure at its bottom. The closure contains one or more gas discharge tubes extending towards the breathing bag. The gas which is freed when the coolant warms up flows through these tubes in the direction toward the breathing bag, where it mixes with the outside air in the respirator and circulates around the breathing bag and the chemical cartridge, thus cooling the outside air. Cooling only the back of the wearer may lead to possible local undercooling despite the presence of the insulating layer and the kidneys, for example, may become overstressed.

SUMMARY OF THE INVENTION

The present invention provides an improved cooling device for respirators which, in addition to supplying effective cooling of the breathing air, improves the equipment wearer's efficiency by cooling the largest possible body area.

In accordance with the present invention, there is provided a vest which is adapted to be worn by a person moving through high temperature areas. The coolant container is connectable to the vest and it is advantageously constructed to fit between outer and inner walls of the vest. The coolant is contained in compartments of the container. A respirator is mounted on the vest and includes means for circulating respiratory air to the wearer and, in addition, it advantageously includes an oxygen container for admitting oxygen to the respiratory air, as well as a chemical cartridge for supplying oxygen to the air and for removing carbon dioxide therefrom as well. The coolant of the vest, for example, the gas generated from the sublimation of carbon dioxide, may be directed over the parts of the respirator so as to cool them and also to cool the respiratory air.

With the inventive apparatus, the problem of cooling the largest possible body areas more effectively is advantageously solved in a simple manner. A vest, which serves as both a carrying device for the respirator and a body cooler, allows the wearer to adapt conveniently to the environment which would otherwise be unbearable because of high temperatures. The cooling vest with the coolant encompasses the upper part of the wearer's torso. Heat dissipation at low unit stress is possible over a large area, and single body sections are not unduly stressed. The ability to separate the respirator from the cooling vest permits the vest to be used separately.

Accordingly, an object of the present invention is to provide an apparatus for use by persons in high temperature areas and in contaminated breathing areas which comprises a vest adapted to be worn by the person, a coolant container connectable to the vest in order to cool the wearer's body in the vicinity of the vest, and a respirator which includes means for circulating respiratory air to the wearer which is mounted on the vest and is advantageously positioned so that it can be cooled by the coolant.

Another object of the invention is to provide an apparatus for use by a person in high temperatures and in contaminated breathing areas which is simple in design, rugged in construction and economical to manufacture.

The various features of novelty which characterize the invention are pointed out with particularlity in the claims annexed to and forming a part of this disclosure. For a better understanding of the invention, its operating advantages and specific objects attained by its uses, reference is made to the accompanying drawings and descriptive matter in which preferred embodiments of the invention are illustrated.

DESCRIPTION OF THE PREFERRED EMBODIMENT

Figure 1:
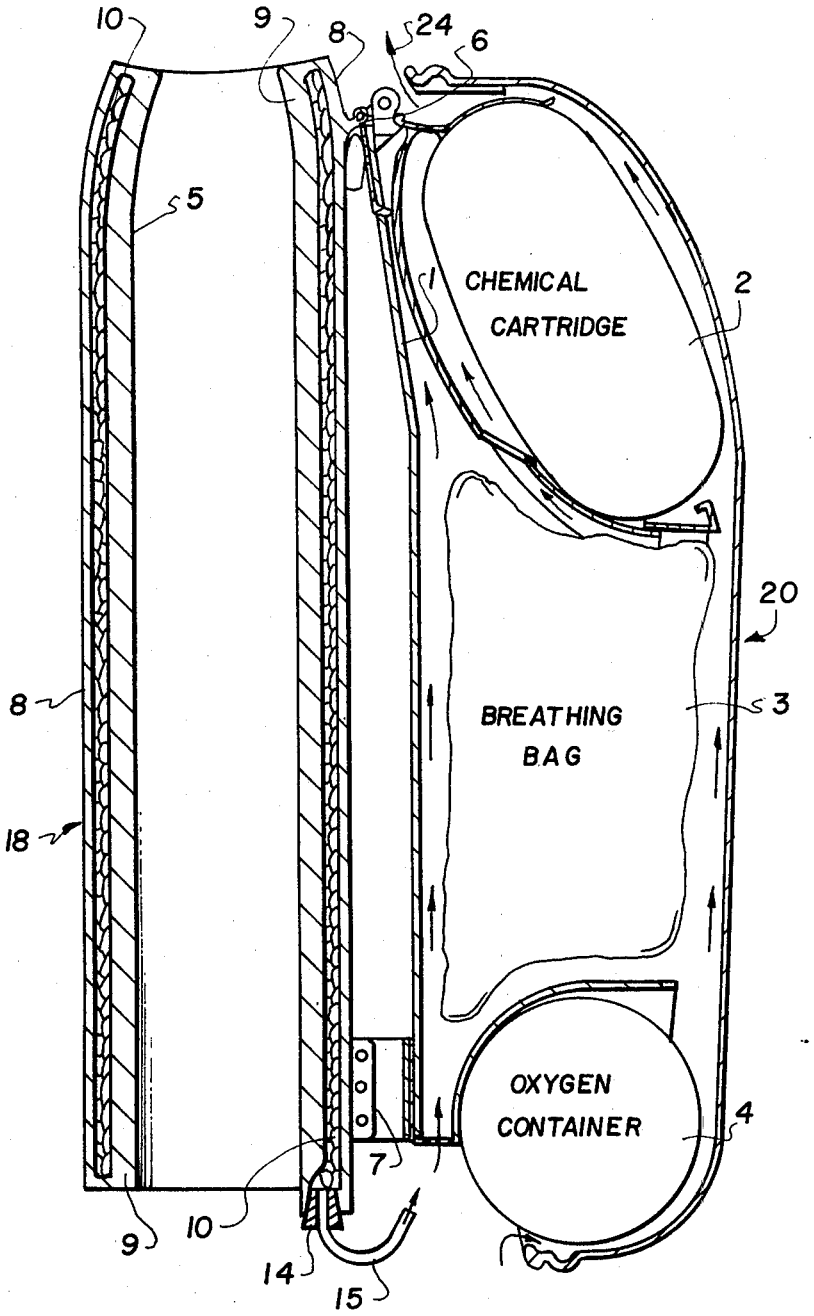
FIG. 1 is a sectional view of an apparatus for use by a person in high temperature areas and contaminated breathing areas, constructed in accordance with the invention.
Figure 2:
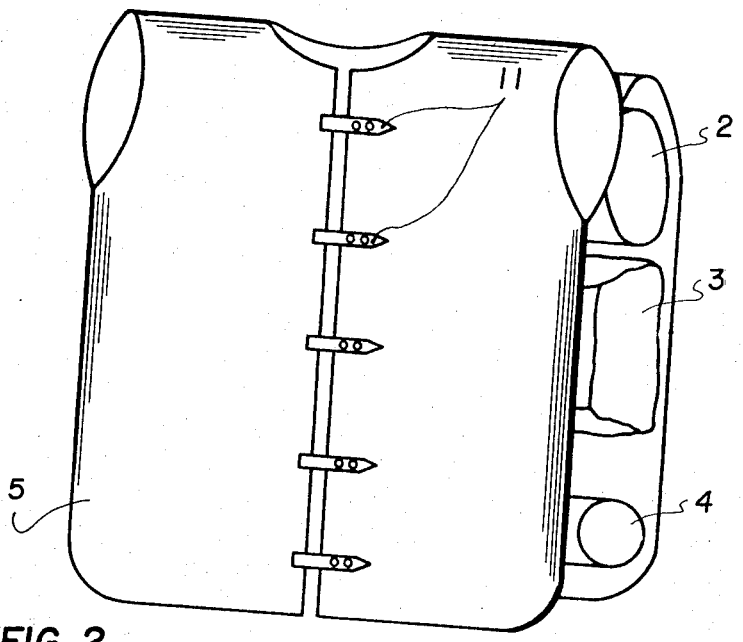
FIG. 2 is a front view of the vest shown in FIG. 1 on a reduced scale.

Referring to the drawings in particular, the invention embodied therein, comprises, an apparatus for use by a person in high temperature and contaminated breathing areas which includes a vest, generally designated 18, which is adapted to be worn by the person, and a respirator, generally designated 20, which is adapted to be mounted on the vest 18 in a position to be cooled by coolant associated with the vest.

In accordance with the invention, the respirator 20 comprises a circulatory apparatus which contains a chemical cartridge 2, with chemicals which bind $CO_2$ and/or form $O_2$ in its carrying frame 1, a breathing bag 3, and an oxygen supply container or $O_2$ bottle 4. The respirator is carried by a cooling vest 5 which serves as the carrying device. Coupling elements 6 and 7 provide for detachable fastening of the respirator 20.

Figure 3:
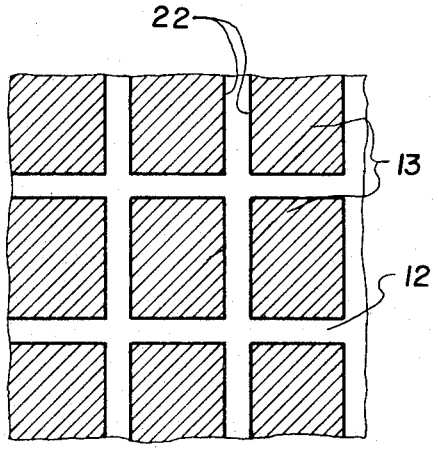
FIG. 3 is a partial sectional view through a container for the coolant which is adapted to be associated with the vest.

The cooling vest 5 is advantageously of a dual wall design to accommodate a coolant. The vest includes an outer wall 8 and an inner wall 9, both of which are made of a flexible material. The interspace 10 is filled with the coolant. The coolant may be either $CO_2$ dry ice or water ice, for example. The cooling vest 5 is tightly closed in front by the closing elements 11. When using a coolant medium, which can be liquefied such as water ice, is kept in an intermediate container part 12, as shown in the embodiment of FIG. 3. The chamber container has grid-like compartments 13 defined by walls or foils 22, between which the coolant is tightly closed and sealed in the coolant compartments 13. The intermediate container part 12 is cooled in a suitable refrigerator before use, in order to then be buttoned between inner and outer vest parts which form the outer wall 8 and the inner wall 9.

When the cooling vest 5 is worn together with the respirator 20, comprehensive, close contact with the wearer's body surface and, thus, uniform cooling is achieved due to the use of a flexible material for the cooling vest 5 and the weight of the respirator. The respirator components are cooled by the ambient air which is caused by the temperature difference to flow by convectively.

When using $CO_2$ dry ice, the cooling vest 5, as shown in the embodiment of FIG. 1, has a stopper 14 at its bottom, which is provided with gas discharge tubes 15. The escaping $CO_2$ gas is conducted through tubes 15 in the direction toward the respirator components in order to contribute to the cooling act. The cooling gas flows over the oxygen container 4, the breathing bag 3 and the cartridge 2 to cool both the components and the breathing air, as shown by the small sized arrows. The single large size arrow 24 shows the exit path of the coolant gas after it has passed over the respirator components. Recirculated respiratory air is admixed with oxygen from either or both of the devices 2 and 4.

While a specific embodiment of the invention has been shown and described in detail to illustrate the application of the principles of the invention, it will be understood that the invention may be embodied otherwise without departing from such principles.

What is claimed is:

1. In combination with a respirator of the type having a carrying frame, a chemical cartridge mounted to the carrying frame for binding carbon dioxide or forming oxygen or both, a breathing bag mounted to the frame and an oxygen supply container mounted to the frame, means for communicating said cartridge, breathing bag and supply container such that exhaled gas from a user is recirculated therethrough for rebreathing, wherein the frame includes ducting means for passing a cooling gas flow over the oxygen container, the breathing bag and the cartridge, a vest adapted to be worn by a person comprising an outer wall of flexible material, an inner wall of flexible material spaced from the outer wall to define a spacing therebetween, a coolant medium comprising dry ice which sublimates to create carbon dioxide coolant gas mounted in said spacing, means for mounting the respirator adjacent of said vest, and further comprising means for discharging said carbon dioxide coolant gas from said spacing to said ducting means for passing the coolant gas to effect a coolant flow over the oxygen container, the breathing bag and the chemical cartridge.

* * * * *